US009708148B2

(12) United States Patent
Yoshitsugu et al.

(10) Patent No.: US 9,708,148 B2
(45) Date of Patent: Jul. 18, 2017

(54) IMAGE FORMING APPARATUS

(71) Applicant: FUJI XEROX CO., LTD., Tokyo (JP)

(72) Inventors: Koji Yoshitsugu, Kanagawa (JP); Ryuichi Sato, Kanagawa (JP); Satoshi Fukada, Kanagawa (JP)

(73) Assignee: FUJI XEROX CO., LTD., Tokyo (JP)

( * ) Notice: Subject to any disclaimer, the term of this patent is extended or adjusted under 35 U.S.C. 154(b) by 0 days.

(21) Appl. No.: 14/952,381

(22) Filed: Nov. 25, 2015

(65) Prior Publication Data

US 2016/0368727 A1 Dec. 22, 2016

(30) Foreign Application Priority Data

Jun. 22, 2015 (JP) ..... 2015-124431

(51) Int. Cl.

| | |
|---|---|
| ***B65H 39/10*** | (2006.01) |
| ***B65H 31/24*** | (2006.01) |
| ***B65H 29/52*** | (2006.01) |
| ***B65H 29/12*** | (2006.01) |
| ***B65H 29/14*** | (2006.01) |

(Continued)

(52) U.S. Cl.

CPC ..... *B65H 31/24* (2013.01); *B65H 29/125* (2013.01); *B65H 29/14* (2013.01); *B65H 29/52* (2013.01); *B65H 29/58* (2013.01); *B65H 29/70* (2013.01); *B65H 2301/4212* (2013.01); *B65H 2301/4219* (2013.01); *B65H 2301/42192* (2013.01); *B65H 2301/4423* (2013.01); *B65H 2301/5122* (2013.01); *B65H 2301/51214* (2013.01); *B65H 2404/1314* (2013.01); *B65H 2404/1424* (2013.01); *B65H 2404/50* (2013.01); *B65H 2404/632* (2013.01); *B65H 2511/17* (2013.01); *B65H 2511/414* (2013.01); *B65H 2801/06* (2013.01)

(58) Field of Classification Search

CPC ..... B65H 29/60; B65H 2404/50; B65H 2301/4423; B65H 2301/415185; B65H 29/58

See application file for complete search history.

(56) References Cited

U.S. PATENT DOCUMENTS 5,551,686 A * 9/1996 Sanchez ..... B65H 39/11 270/58.18
6,307,621 B1 * 10/2001 Endo ..... B65H 3/0615 346/134

(Continued)

FOREIGN PATENT DOCUMENTS

JP 2008-063071 A 3/2008
JP 2012-106827 A 6/2012

*Primary Examiner* — Howard Sanders
(74) *Attorney, Agent, or Firm* — Oliff PLC

(57) ABSTRACT

An image forming apparatus includes plural medium transport paths that branch at a predetermined branching position and along which a medium is transported in a curved state; a switching member disposed at the branching position and including a guide surface that allows the medium to be transported along one of the medium transport paths, the switching member switching between the medium transport paths; an output unit that outputs the medium toward a stacking portion, on which the medium is to be stacked, while corrugating the medium; and a guide portion that guides the medium from the branching position toward the output unit in a region in which the medium is corrugated.

8 Claims, 9 Drawing Sheets

(51) Int. Cl.
*B65H 29/58* (2006.01)
*B65H 29/70* (2006.01)

(56) References Cited

U.S. PATENT DOCUMENTS

| | | | | |
|---|---|---|---|---|
| 6,308,952 | B1 * | 10/2001 | Takagi | B65H 31/22 271/297 |
| 8,523,175 | B2 | 9/2013 | Kobayashi et al. | |
| 2005/0159287 | A1 * | 7/2005 | Kaneko | B26D 5/32 493/421 |
| 2013/0248322 | A1 * | 9/2013 | Okamoto | B65G 47/52 198/367 |
| 2014/0353901 | A1 * | 12/2014 | Aoyama | B65H 5/26 271/3.19 |
| 2015/0091239 | A1 * | 4/2015 | Iwasawa | G03G 15/234 271/3.18 |

* cited by examiner

IMAGE FORMING APPARATUS

CROSS-REFERENCE TO RELATED APPLICATIONS

This application is based on and claims priority under 35 USC 119 from Japanese Patent Application No. 2015-124431 filed Jun. 22, 2015.

BACKGROUND

Technical Field

The present invention relates to an image forming apparatus.

Summary

According to an aspect of the invention, there is provided an image forming apparatus including plural medium transport paths that branch at a predetermined branching position and along which a medium is transported in a curved state; a switching member disposed at the branching position and including a guide surface that allows the medium to be transported along one of the medium transport paths, the switching member switching between the medium transport paths; an output unit that outputs the medium toward a stacking portion, on which the medium is to be stacked, while corrugating the medium; and a guide portion that guides the medium from the branching position toward the output unit in a region in which the medium is corrugated.

BRIEF DESCRIPTION OF THE DRAWINGS

Exemplary embodiments of the present invention will be described in detail based on the following figures, wherein.

DETAILED DESCRIPTION

Figure 1:
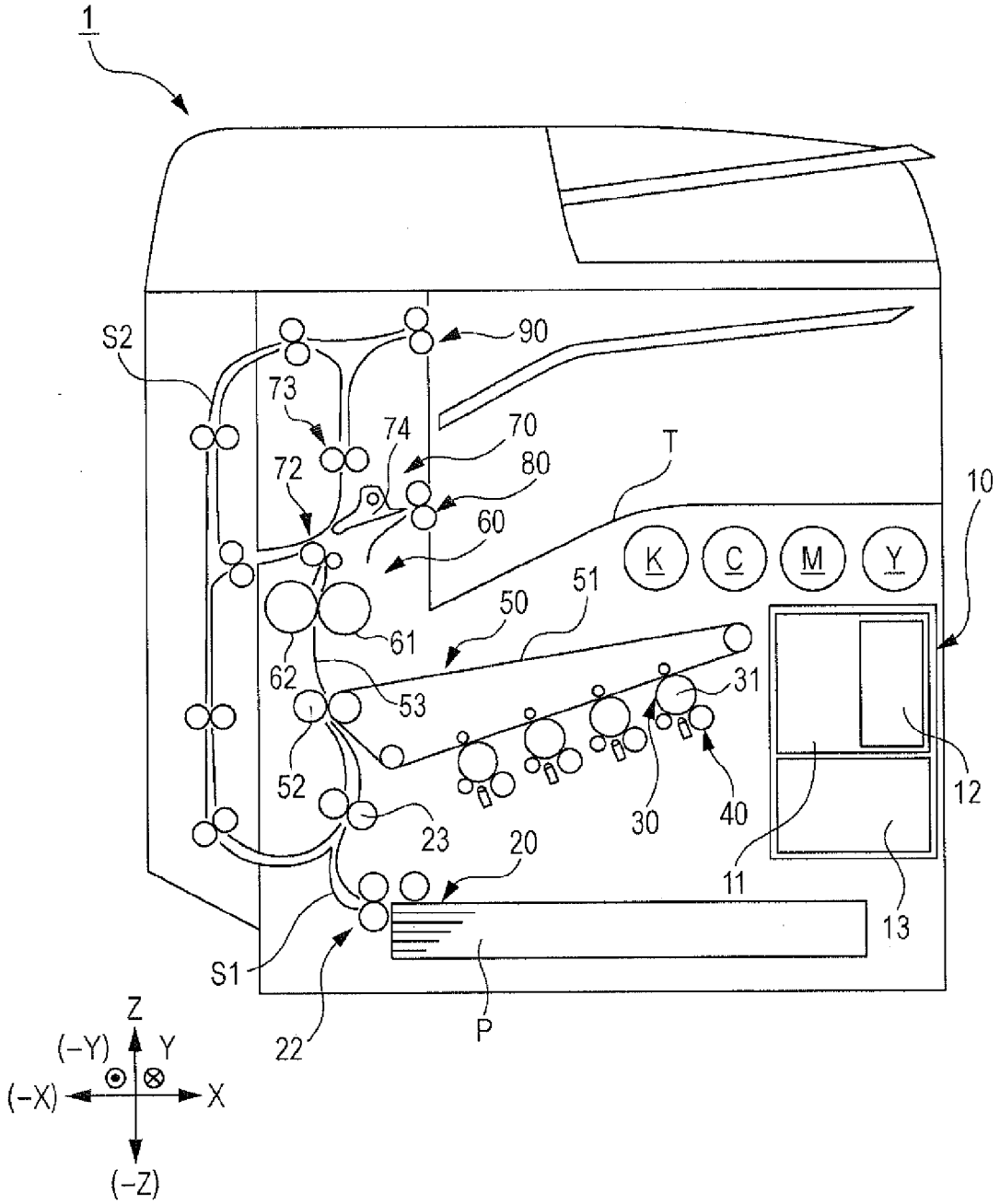
FIG. 1 is a sectional schematic diagram illustrating the inner structure of an image forming apparatus.

The present invention will be explained in further detail by describing exemplary embodiments and examples with reference to the drawings. However, the present invention is not limited to the exemplary embodiments and examples.

It is to be noted that the drawings referred to in the following description are schematic, and that dimensional ratios, for example, are not equal to the actual dimensional ratios. Components other than those needed to be explained to facilitate understanding are omitted as appropriate in the drawings.

First Exemplary Embodiment

1. Overall Structure and Operation of Image Forming Apparatus

FIG. 1 is a vertical sectional view illustrating the inner structure of an image forming apparatus 1.

The overall structure and operation of the image forming apparatus 1 will be described with reference to the drawings.

The image forming apparatus 1 includes a control device 10, a sheet feeding device 20, photoconductor units 30, developing devices 40, a transfer device 50, and a fixing device 60. A paper output tray unit T, which receives paper sheets having images recorded thereon, is provided on an upper surface (Z-direction-side surface) of the image forming apparatus 1.

The control device 10 includes a controller 11 that controls the operation of the image forming apparatus 1, an image processing unit 12 that performs an operation controlled by the controller 11, and a power supply device 13. The power supply device 13 applies a voltage to devices including the photoconductor units 30, the developing devices 40, and the transfer device 50.

The image processing unit 12 converts print information input thereto from an external information transmission device (for example, a personal computer) into image information used to form a latent image, and outputs a drive signal to an exposure device at a preset timing.

A sheet feeding device 20 that contains a stack of paper sheets P, which serve as media, is provided at the bottom of the image forming apparatus 1. The paper sheets P, which are positioned in a width direction by a regulating plate (not shown), are drawn out one at a time in the forward direction (−X direction) by a sheet drawing unit 22.

The paper sheets P drawn out by the sheet drawing unit 22 is transported along a first sheet transport path 91 to a nip portion of a registration roller pair 23.

The photoconductor units 30 include photoconductor drums 31 that are arranged next to each other in a region above (on the Z-direction side of) the sheet feeding device 20. Yellow (Y), magenta (M), cyan (C), and black (K) toner images are formed on the photoconductor drums 31 by the respective developing devices 40.

The toner images of the respective colors formed on the photoconductor drums 31 of the photoconductor units 30 are successively electrostatically transferred onto an intermediate transfer belt 51, which is included in the transfer device 50, in a first transfer process, so that a superposed toner image in which the toners of the respective colors are superposed is formed. The superposed toner image formed on the intermediate transfer belt 51 is transferred, by a second transfer roller 52 onto a paper sheet P that has been transported from the registration roller pair 23 and guided by a transport guide.

The fixing device 60 includes a fixing nip portion (fixing region) in a region in which a pair of modules, which are a heating module 61 and a pressing module 62, are pressed against each other.

The paper sheet P onto which the toner image has been transferred by the transfer device 50 is transported to the fixing nip portion of the fixing device 60 along a transport guide 53 while the toner image is not fixed. The pair of modules, which are the heating module 61 and the pressing module 62, apply heat and pressure to the toner image to fix the toner image.

The paper sheet P on which the fixed toner image is formed is guided by a sheet transport device 70 and output to the paper output tray unit T on the upper surface of the image forming apparatus 1 from a first output roller pair 80. When duplex printing is to be performed, a switching gate 74 switches the transporting direction to a direction toward a second transport path, and a second output roller pair 90 is driven in the reverse direction so that the paper sheet P is transported from a reversing transport path S2 to the registration roller pair 23. Then, an image is formed on the back surface of the paper sheet P.

2. Structure and Operation of Sheet Transport Device

Figure 2:
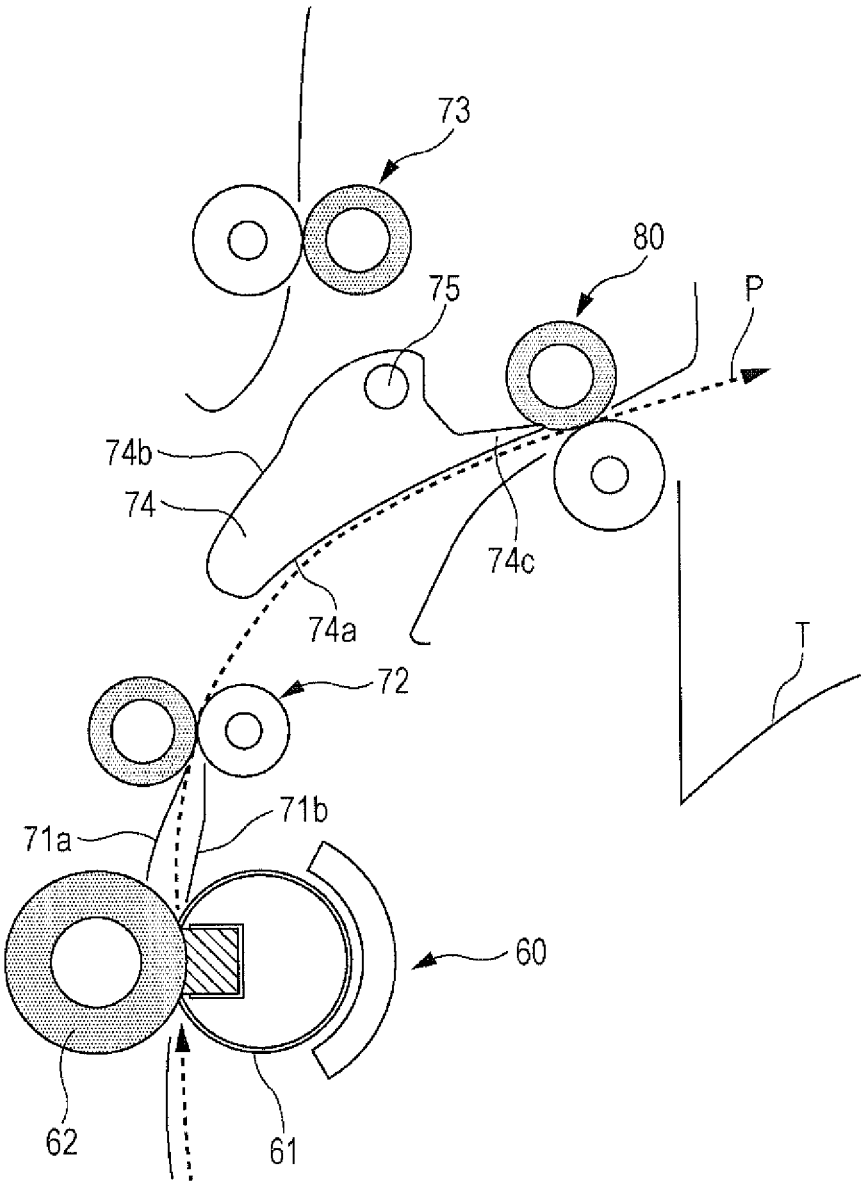
FIG. 2 is a sectional schematic diagram illustrating a sheet transporting operation of a sheet transport device in a state in which a switching gate is switched to a first position.
Figure 3:
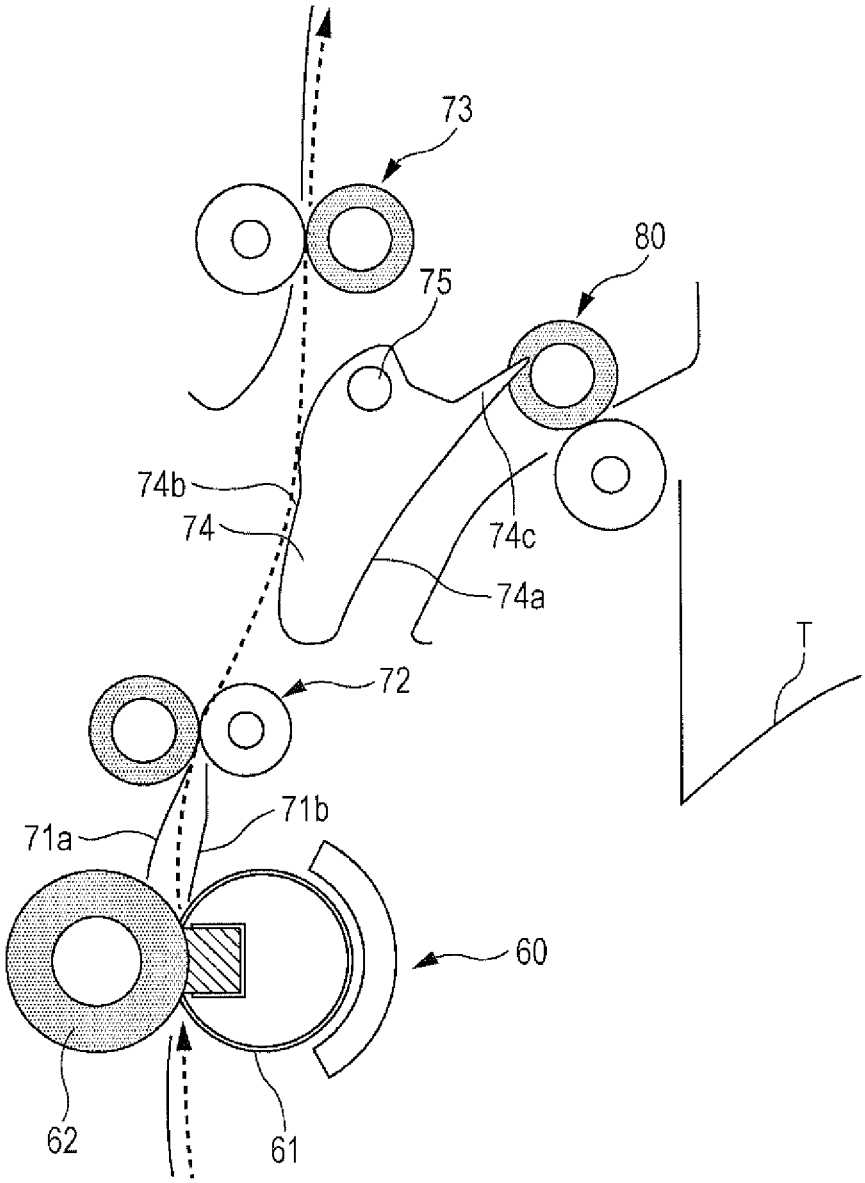
FIG. 3 is a sectional schematic diagram illustrating the sheet transporting operation of the sheet transport device in a state in which the switching gate is switched to a second position.
Figure 4:
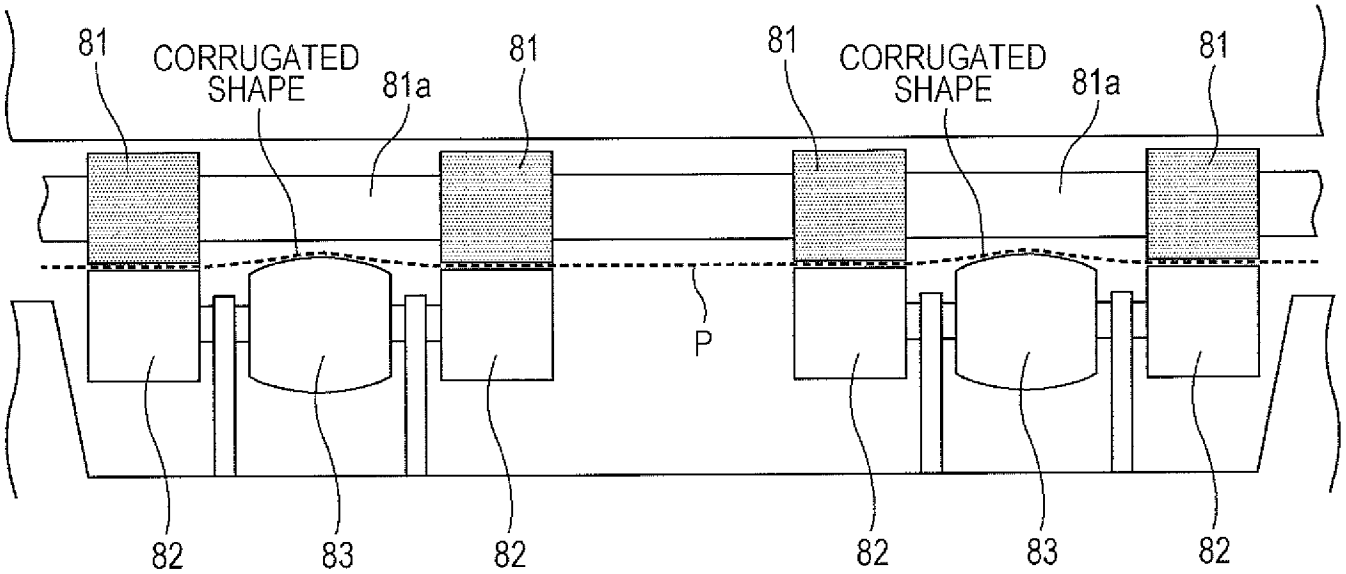
FIG. 4 is a diagram illustrating how a paper sheet is corrugated in a paper output unit.
Figure 5:
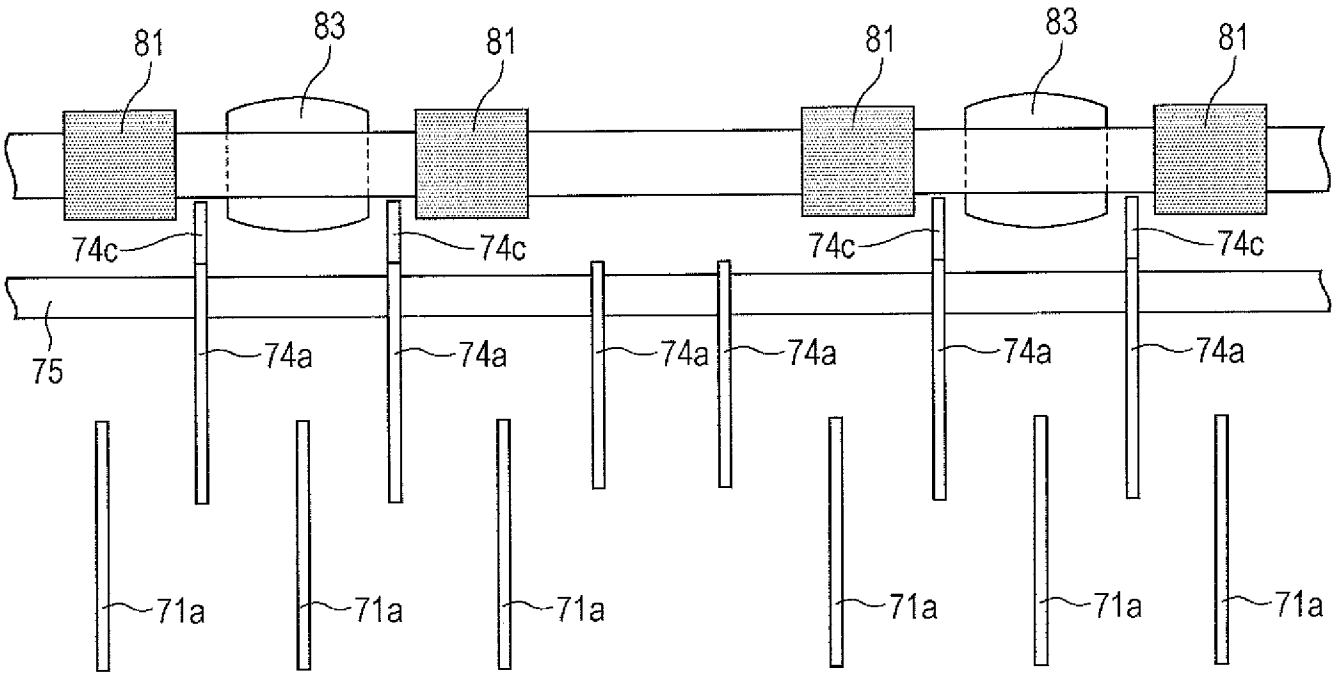
FIG. 5 is a plan schematic diagram illustrating the positional relationship between the switching gate and a first output roller pair.
Figure 6:
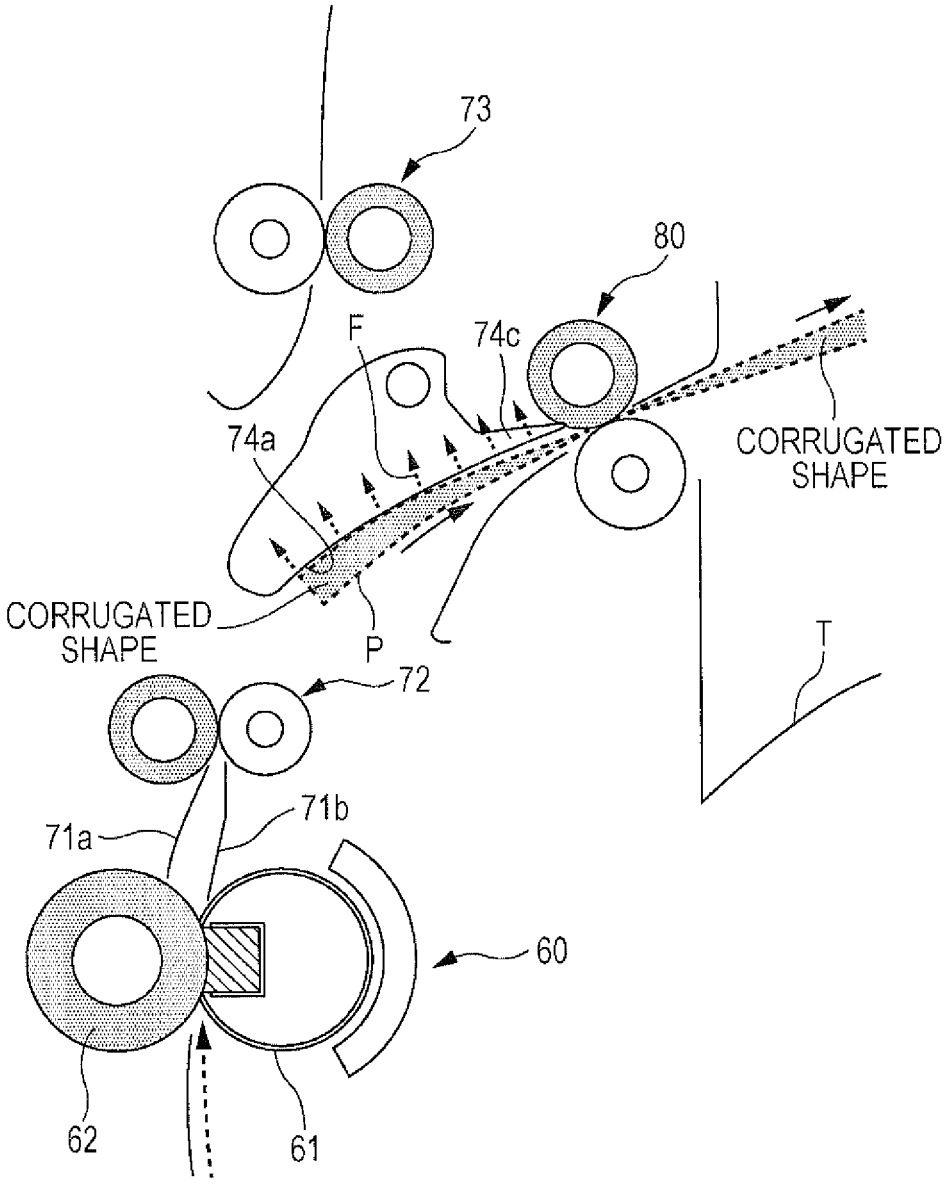
FIG. 6 is a sectional schematic diagram illustrating the manner in which the trailing end of a corrugated paper sheet is transported.

FIG. 2 is a sectional schematic diagram illustrating a sheet transporting operation of the sheet transport device 70 in a state in which the switching gate 74 is switched to a first position. FIG. 3 is a sectional schematic diagram illustrating the sheet transporting operation of the sheet transport device 70 in a state in which the switching gate 74 is switched to a second position. FIG. 4 is a diagram illustrating how a paper sheet is corrugated in a paper output unit. FIG. 5 is a plan schematic diagram illustrating the positional relationship between the switching gate 74 and the first output roller pair 80. FIG. 6 is a sectional schematic diagram illustrating the manner in which the trailing end of a corrugated paper sheet is transported.

The structure and sheet transporting operation of the sheet transport device 70 included in the image forming apparatus 1 will be described with reference to the drawings.

2.1. Structure of Sheet Transport Unit

Referring to FIG. 2, the sheet transport device 70 of the image forming apparatus 1 includes guides 71*a* and 71*b*, transport roller pairs 72 and 73, the switching gate 74, and the first output roller pair 80.

The guides 71*a* and 71*b*, which are located downstream of the fixing nip portion of the fixing device 60, guide the paper sheet P to which the toner image is fixed to the transport roller pair 72. The sheet transport path that extends from the transport roller pair 72 to the first output roller pair 80 is defined by the switching gate 74.

The switching gate 74 is supported by a support shaft 75 so as to be rotatable between a first position for guiding the paper sheet P to the first output roller pair 80, as illustrated in FIG. 2, and a second position for guiding the paper sheet P to the second output roller pair 90, as illustrated in FIG. 3.

In a state in which the switching gate 74 is at the first position for guiding the paper sheet P to the first output roller pair 80, the sheet transport path from the transport roller pair 72 to the first output roller pair 80 is curved so that an increase in the height of the apparatus is suppressed.

The switching gate 74 has first guide surfaces 74*a*, second guide surfaces 74*b*, and third guide surfaces 74*c*, and is supported so as to be rotatable around the support shaft 75.

The third guide surfaces 74*c* are integrally connected to the corresponding first guide surfaces 74*a* so as to extend toward a front side (toward the first output roller pair 80) to a position where the front ends thereof overlap the first output roller pair 80 when viewed in the axial direction, thereby defining a first transport path that guides the paper sheet P transported by the transport roller pair 72 to a nip portion of the first output roller pair 80.

The second guide surfaces 74*b* define a second transport path that guides the paper sheet P transported by the transport roller pair 72 to a nip portion of the transport roller pair 73.

The first output roller pair 80 includes drive rollers 81 that are rotated, pinch rollers 82 that are pressed against the drive rollers 81 in a rotatable manner, and corrugation rollers 83 that are disposed between the pinch rollers 822 in a rotatable manner. When the first output roller pair 80 is rotationally driven, the paper sheet P is output to the paper output tray unit T.

As schematically illustrated in FIG. 4, the first output roller pair 80 includes a corrugation unit that forms plural vertically concave portions in the paper sheet P along the direction in which the paper sheet P is output to increase the stiffness of the paper sheet P that is output and improve the travelling stability of the paper sheet P that is output.

More specifically, central portions of the corrugation rollers 83, which are disposed between the pinch rollers 82, have outer diameters greater than those of the pinch rollers 82 so that, when the paper sheet P is output, the paper sheet P is formed into a corrugated shape that undulates in a direction perpendicular to the direction in which the paper sheet P is output, and the stiffness of the paper sheet P is increased.

Referring to FIG. 5, in a region in which the corrugation unit of the first output roller pair 80 is disposed, the switching gate 74 has the third guide surfaces 74*c*, each of which is integrally connected to the corresponding first guide surface 74*a* so as to extend toward the front side (toward the first output roller pair 80). The third guide surfaces 74*c* are disposed near the corrugation unit of the first output roller pair 80 in the sheet transporting direction.

2.2. Sheet Transporting Operation

In the sheet transport device 70 having the above-described structure, when the leading end of the paper sheet P is nipped by the first output roller pair 80 and the process of outputting the paper sheet P is started, the paper sheet P is corrugated by the corrugation unit. The paper sheet P is corrugated not only in a region downstream of the first output roller pair 80 but also in a region upstream of the first output roller pair 80.

Accordingly, as schematically illustrated in FIG. 6, the paper sheet P is transported while the trailing end portion of the paper sheet P is pressed against the first guide surfaces 74*a* and the third guide surfaces 74*c* of the switching gate 74 in such a state that the trailing end portion is curved and corrugated so that the stiffness thereof is increased (see F in FIG. 6).

In a region between the switching gate 74, which defines the sheet transport paths and which is supported so as to be rotatable between the first position and the second position, and the nip portion of the first output roller pair 80, a step is easily formed in the sheet transporting direction. Accordingly, when the trailing end of the paper sheet P passes the first guide surfaces 74*a* of the switching gate 74, there is a risk that a large impact noise will be caused by flapping of the paper sheet P that is stiff.

In the sheet transport device 70 according to the present exemplary embodiment, the sheet transport path from the transport roller pair 72 to the first output roller pair 80 is defined by the switching gate 74. The switching gate 74 includes the first guide surfaces 74*a* that guide the paper sheet P to the nip portion of the first output roller pair 80, and the third guide surfaces 74*c* that are integrally connected to the corresponding first guide surfaces 74*a* so as to extend toward the front side (toward the first output roller pair 80) to a position where the front ends thereof overlap the first output roller pair 80 when viewed in the axial direction.

As a result, the sheet transport path that is curved between the first guide surfaces 74*a* of the switching gate 74 and the nip portion of the first output roller pair 80 does not have a step portion that is stepped toward the curved side.

Accordingly, the trailing end of the paper sheet P is guided while being pressed against the third guide surfaces 74*c*, which are connected to the corresponding first guide surfaces 74*a*, until the trailing end of the paper sheet P reaches the nip portion of the first output roller pair 80. Thus, the large impact noise caused by flapping of the paper sheet P that is stiff is suppressed.

Second Exemplary Embodiment

Figure 7:
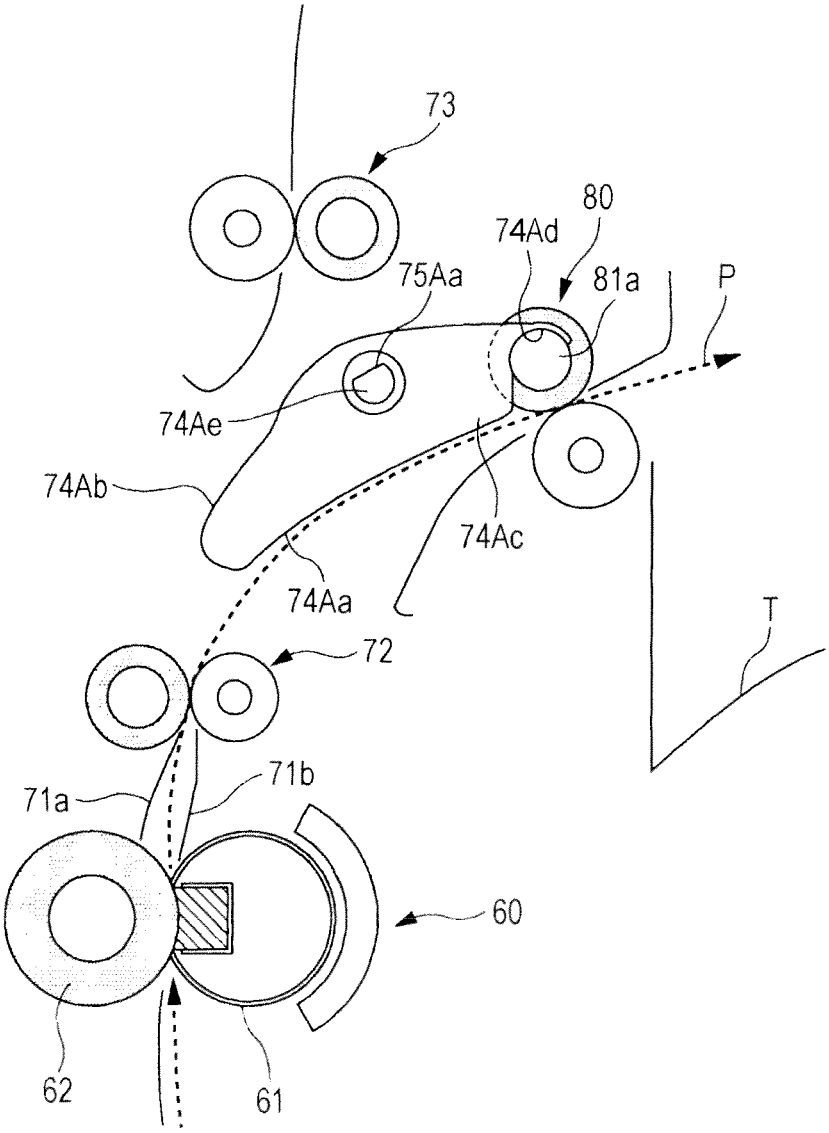
FIG. 7 is a sectional schematic diagram illustrating a sheet transporting operation of a sheet transport device in a state in which a switching gate is switched to a first position.
Figure 8:
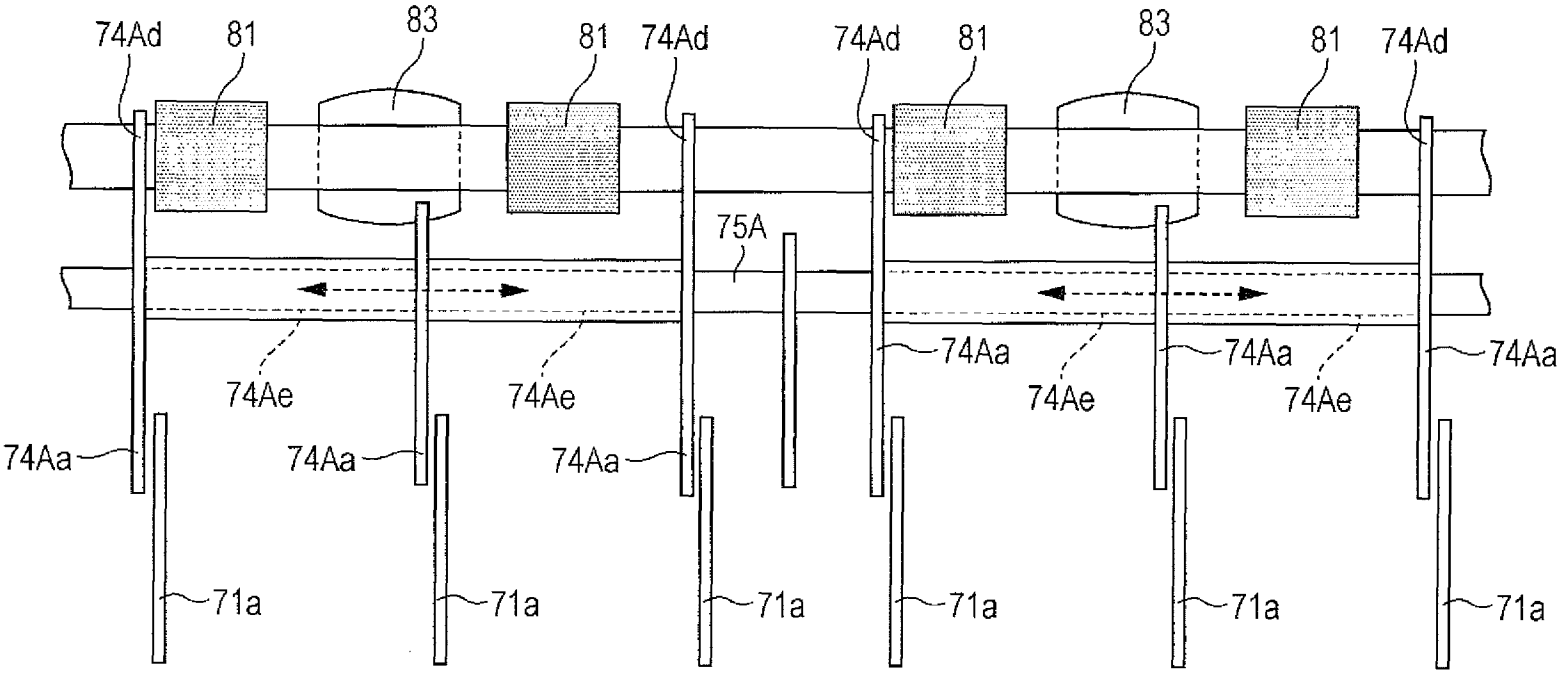
FIG. 8 is a plan schematic diagram illustrating the positional relationship between the switching gate and a first output roller pair.
Figure 9:
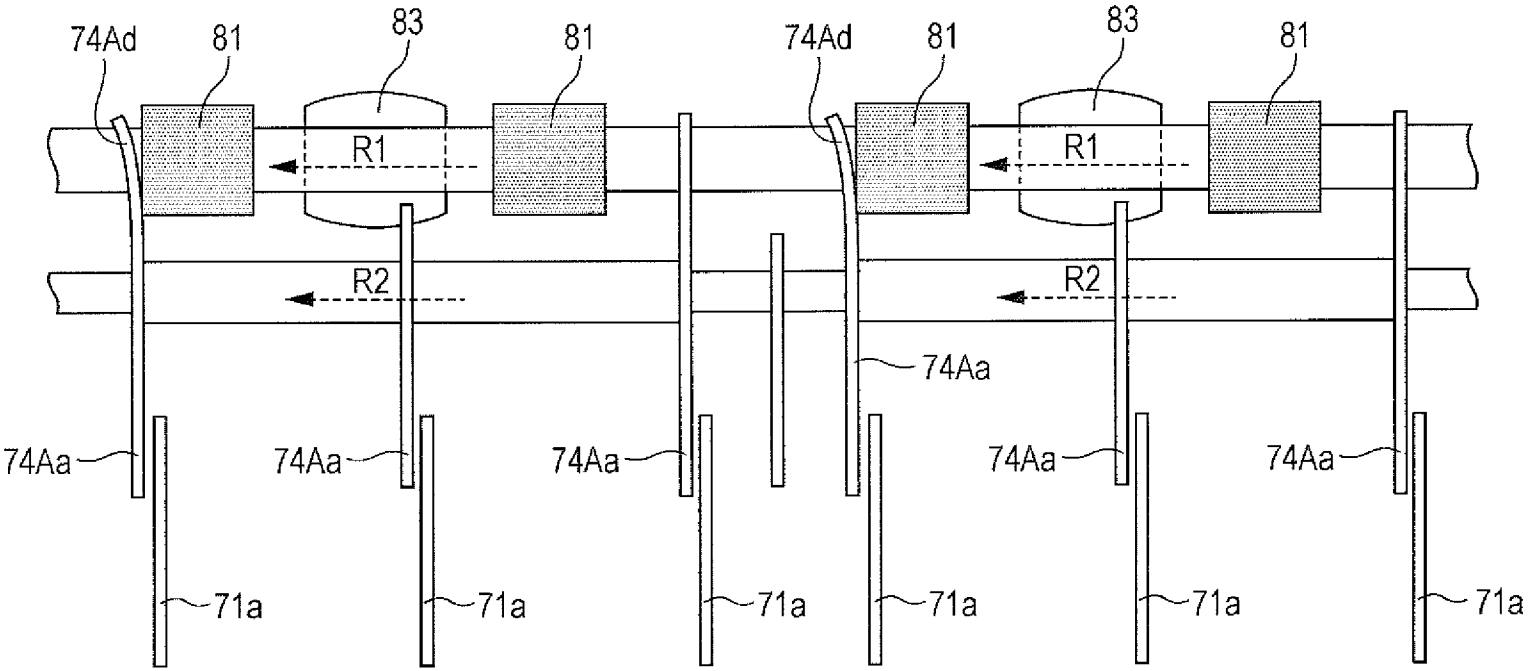
FIG. 9 is a plan schematic diagram illustrating the deformation of the switching gate during an offset operation.

FIG. 7 is a sectional schematic diagram illustrating a sheet transporting operation of a sheet transport device 70A in a state in which a switching gate 74A is switched to a first position. FIG. 8 is a plan schematic diagram illustrating the positional relationship between the switching gate 74A and a first output roller pair 80. FIG. 9 is a plan schematic diagram illustrating the deformation of the switching gate 74A during an offset operation.

The structure and sheet transporting operation of the sheet transport device 70A included in an image forming apparatus 1 will be described with reference to the drawings. Components similar to those in the sheet transport device 70 according to the first exemplary embodiment are denoted by the same reference numerals, and detailed descriptions thereof are thus omitted.

As illustrated in FIG. 7, the sheet transport device 70A includes guides 71*a* and 71*b*, transport roller pairs 72 and 73, the switching gate 74A, and the first output roller pair 80.

The switching gate 74A is supported so as to be rotatable around a support shaft 75A at a location downstream of the transport roller pair 72. The switching gate 74A has first guide surfaces 74Aa that guide the paper sheet P transported by the transport roller pair 72 to the nip portion of the first output roller pair 80; second guide surfaces 74Ab that guide the paper sheet P transported by the transport roller pair 72 to the nip portion of the transport roller pair 73; and third guide surfaces 74Ac that are integrally connected to the corresponding first guide surfaces 74Aa so as to extend toward the front side (toward the first output roller pair 80).

Shaft-receiving portions 74Ad are formed integrally with the switching gate 74A at the end of the switching gate 74A near the third guide surfaces 74Ac, and are in contact with and supported by a shaft 81*a* of drive rollers 81 included in the first output roller pair 80.

The switching gate 74A includes shaft portions 74Ae, through which holes having a D-cut surface extend, and is supported so as to be movable in the axial direction of the support shaft 75A by being guided by a D-cut surface 75Aa formed on a portion of the support shaft 75A (see the arrows in FIG. 8). The shape is not limited to the D-cut shape as long as the switching gate is capable of moving in the axial direction while being rotated by the shaft.

The third guide surfaces 74Ac of the switching gate 74A are elastically deformable. There is no particular limitation regarding the material of the switching gate 74A. The switching gate 74A is formed integrally with the shaft portions 74Ae by using a resin material containing a rubber component, an elastomer, or the like.

In the sheet transport device 70A having the above-described structure, the sheet transport path from the transport roller pair 72 to the first output roller pair 80 is defined by the switching gate 74A. The trailing end of the paper sheet P corrugated by the corrugation unit is guided while being pressed against the third guide surfaces 74*c*, which are connected to the first guide surfaces 74*a*, until the trailing end of the paper sheet P reaches the nip portion of the first output roller pair 80.

As a result, the sheet transport path that is curved between the first guide surfaces 74Aa of the switching gate 74A and the nip portion of the first output roller pair 80 does not have a step portion that is stepped toward the curved side, and the large impact noise caused by flapping of the paper sheet P that is stiff is suppressed.

In addition, in the present exemplary embodiment, a moving portion (not shown) that moves the first output roller pair 80 in a direction that crosses the transporting direction of the paper sheet P (direction substantially perpendicular to the transporting direction of the paper sheet) is provided. By moving the first output roller pair 80 with the moving unit, an offset operation for outputting the paper sheet P at positions shifted from each other in the direction that crosses the sheet transporting direction may be performed.

Referring to FIG. 9, when the offset operation is performed, the first output roller pair 80 is moved in the direction that crosses the transporting direction of the paper sheet P (see the arrows R1 in FIG. 9).

The shaft-receiving portions 74Ad are supported by the shaft 81*a* of drive rollers 81 included in the first output roller pair 80 while being in contact with the shaft 81*a*. Therefore, even when the first output roller pair 80 is moved, the state in which the sheet transport path from the transport roller pair 72 to the first output roller pair 80 is defined by the switching gate 74A is maintained.

When the first output roller pair 80 is further moved in the direction that crosses the transporting direction of the paper sheet P and the drive rollers 81 come into contact with the shaft-receiving portions 74Ad of the switching gate 74A, the third guide surfaces 74Ac of the switching gate 74A are elastically deformed. Since the switching gate 74A is supported so as to be movable in the axial direction of the support shaft 75A, the switching gate 74A moves in the same direction as the direction in which the first output roller pair 80 is moved (see the arrows R2 in FIG. 9).

As a result, the state in which the sheet transport path from the transport roller pair 72 to the first output roller pair 80 is defined by the switching gate 74A is maintained, and the large impact noise generated when the stiff paper sheet P is transported is suppressed.

The foregoing description of the exemplary embodiments of the present invention has been provided for the purposes of illustration and description. It is not intended to be exhaustive or to limit the invention to the precise forms disclosed. Obviously, many modifications and variations will be apparent to practitioners skilled in the art. The embodiments were chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. An image forming apparatus comprising:

a plurality of medium transport paths that branch at a predetermined branching position and along which a medium is transported in a curved state;

a switching member disposed at the branching position and comprising a plurality of guide surfaces that allow the medium to be transported along one of the medium transport paths, the switching member switching between the medium transport paths; and an output unit that outputs the medium toward a stacking portion, on which the medium is to be stacked, while corrugating the medium, wherein the output unit comprises a rotating member that rotates around a shaft, at least one of the plurality of guide surfaces guides the medium from the branching position toward the output unit in a region in which the medium is corrugated, the plurality of guide surfaces are integrally connected so that the switching member extends toward a front side in a medium transporting direction to a position where a portion of the switching member overlaps the rotating member when viewed in a direction of the shaft, the portion of the switching member that overlaps the rotating member extends partially around the shaft, and the portion that extends partially around the shaft directly contacts the shaft.

2. The image forming apparatus according to claim 1, wherein the output unit further comprises:

a driven member that faces the rotating member, and a projecting member that projects toward the medium beyond a contact position at which the rotating member and the driven member are in contact with each other.

3. The image forming apparatus according to claim 2, wherein the switching member is movable in a direction that crosses the medium transporting direction.

4. The image forming apparatus according to claim 3, wherein the switching member is supported while being in contact with the shaft.

5. The image forming apparatus according to claim 2, wherein the switching member is supported while being in contact with the shaft.

6. The image forming apparatus according to claim 1, wherein the switching member is movable in a direction that crosses a medium transporting direction.

7. The image forming apparatus according to claim 6, wherein the output unit further comprises a driven member that faces the rotating member, and a projecting member that projects toward the medium beyond a contact position at which the rotating member and the driven member are in contact with each other, and wherein the switching member is supported while being in contact with the shaft.

8. The image forming apparatus according to claim 1, wherein the output unit further comprises a driven member that faces the rotating member, and a projecting member that projects toward the medium beyond a contact position at which the rotating member and the driven member are in contact with each other, and wherein the switching member is supported while being in contact with the shaft.

* * * * *